US008888033B2

(12) United States Patent
Hiebenthal

(10) Patent No.: US 8,888,033 B2
(45) Date of Patent: Nov. 18, 2014

(54) SPRING-DRIVEN REEL

(75) Inventor: Benjamin B. Hiebenthal, Fremont, NE (US)

(73) Assignee: Conductix, Inc., Omaha, NE (US)

( * ) Notice: Subject to any disclaimer, the term of this patent is extended or adjusted under 35 U.S.C. 154(b) by 189 days.

(21) Appl. No.: 13/613,585

(22) Filed: Sep. 13, 2012

(65) Prior Publication Data

US 2014/0070041 A1 Mar. 13, 2014

(51) Int. Cl.
*B65H 75/48* (2006.01)

(52) U.S. Cl.
USPC ..... 242/375; 242/375.1

(58) Field of Classification Search
CPC ..... B65H 75/486; B65H 75/4402; B65H 2403/481
USPC ..... 242/371–373, 375, 375.1
See application file for complete search history.

(56) References Cited

U.S. PATENT DOCUMENTS 2,303,002 A 11/1942 Ruddock
2,587,652 A * 3/1952 Rostine ..... 242/375
2,645,432 A 7/1953 Griffitts
2,658,698 A * 11/1953 Leroy ..... 242/372
3,916,974 A * 11/1975 Lidin ..... 160/319
4,611,688 A * 9/1986 Sekhar ..... 182/237
5,236,144 A * 8/1993 Kautz ..... 242/371
5,833,016 A * 11/1998 Carpenter ..... 175/85
2007/0272787 A1* 11/2007 Jian ..... 242/389

FOREIGN PATENT DOCUMENTS

JP 09-231130 * 9/1996 ..... B65H 75/48
JP 10-109834 * 4/1998 ..... B65H 75/42

OTHER PUBLICATIONS

International Search Report mailed Oct. 21, 2013, in Application Serial No. PCT/US2013/053185.*

* cited by examiner

*Primary Examiner* — Sang Kim

(74) *Attorney, Agent, or Firm* — Rayn T. Grace; Advent, LLP

(57) ABSTRACT

A spring-driven reel adapted to have a line or cable wound onto the spool of the cable. As the line or cable is pulled from said spool, a helical spring is compressed. The helical spring causes the line or cable to be wound upon the spool if slack occurs in the line or cable.

20 Claims, 8 Drawing Sheets

SPRING-DRIVEN REEL

BACKGROUND OF THE INVENTION

1. Field of the Invention

This invention relates to a spring-driven reel for maintaining a line, cable or the like under tension and free of slack as the effective length of the line or cable varies. More particularly, this invention relates to an elongated helical spring which is compressed when the line or cable is unwound from the spool of the device with the compressed spring rotating the spool in a winding manner to wind the line or cable upon the spool as the effective length of the line or cable is shortened.

2. Description of the Related Art

Many types of spring-driven reels have been previously provided for use with cranes, hoists, etc., which employ lines or cables which supply electrical power to a traveling object. As the object is moved away from the reel, the line or cable is unwound from the spool of the reel. As the object is moved towards the reel, the spring rotates the spool to wind the line or cable onto the spool. In the past, most springs were of the "clock" type. Although the "clock" type springs do function well, the life thereof is rather limited which requires extensive disassembly of the reel to replace the spring.

In an effort to overcome the shortcomings of the "clock" type springs, elongated helical or linear springs have been substituted for the "clock" type springs. U.S. Pat. No. 2,303,002 to Ruddock discloses an elongated helical spring which has one end thereof fixed to a support with the other end being rotated to twist the spring into tension as the line is pulled from the spool by the object moving away from the reel. When the object is moved towards the reel, thereby causing slack in the line, the twisted spring unwinds to rotate the spool to wind the line onto the spool. In U.S. Pat. No. 2,645,432, an improvement to the reel of U.S. Pat. No. 2,303,002 is disclosed.

In both of the designs of the aforementioned patents, the rotational twisting of the helical springs eventually causes the spring to fail.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A spring-driven reel is disclosed which includes a first horizontally disposed support. First and second upstanding support members have their lower ends secured to the first support and extend upwardly therefrom so that the first and second support members are horizontally spaced from one another.

A spool is positioned between the first and second support members with the spool being rotatably mounted thereon. The spool includes first and second vertically disposed and horizontally spaced-apart disc-shaped flanges which have a central drum-like portion extending therebetween. The spool is adapted to have an elongated line or cable wound on the drum-like portion thereof. A horizontally disposed shaft is provided which has first and second ends. The first end of the shaft is fixed to the second flange for rotation therewith. The shaft extends horizontally outwardly from the second flange of the spool through the second support member. The spool and the shaft are rotatable in a first direction and a second direction. The rotation of the spool and the shaft in the first direction permits the line or cable to be unwound from the spool. The rotation of the spool and the shaft in the second direction causes the line or cable to be wound upon the drum-like portion of the spool.

A housing is secured to the first support laterally outwardly of the second support member. One or more horizontally disposed helical spring assemblies are secured to the housing and extend laterally outwardly therefrom. Each of the helical spring assemblies includes a horizontally disposed tubular support having a first end and a closed second end. The tubular support extends laterally outwardly from the housing. An elongated, horizontally disposed screw member, having first and second ends, is rotatably mounted in the tubular support. A non-rotatable nut is longitudinally movably mounted on the screw member in the tubular support adjacent the first end of the screw member. Each of the helical spring assemblies includes an elongated helical spring having first and second ends. The screw member extends through the helical spring with the helical spring being mounted on the screw member so that the first end of the helical spring operatively engages the non-rotatable nut and so that the second end of the helical spring operatively engages the closed second end of the tubular support. The first end of the screw member is operatively connected to the second end of the shaft whereby rotation of the shaft causes the screw member to be rotated. The rotation of the shaft in the first direction by the line or cable being unwound from the drum-like portion of the spool causes the screw member to be rotated with respect to the non-rotatable nut which causes the nut to be longitudinally moved outwardly on the screw member towards the second end of the tubular support thereby compressing the helical spring to put the helical spring in tension. The tension in the helical spring, after the helical spring has been compressed by the rotation of the first shaft in the first direction, causes the non-rotatable nut to be longitudinally moved inwardly on the screw member thereby causing the screw member, the first shaft and the spool to be rotated in the second direction upon the occurrence of slack in the line or cable, to wind the line or cable on the spool.

As stated, the tubular support, screw member, helical spring and non-rotatable nut comprise a helical spring assembly. One or more of the helical spring assemblies may be secured to the housing with the screw members thereof being operatively connected to the shaft for rotation therewith.

In the preferred embodiment, the shaft is connected to the screw member by a gear assembly positioned in the housing. Preferably, each of the helical spring assemblies includes means for placing the helical spring therein into a pre-set compression to prevent the spool from unwinding when in its non-rotatable mode prior to the line or cable being pulled outwardly therefrom.

It is therefore a principal object of the invention to provide an improved spring-driven reel.

A further object of the invention is to provide a spring-driven reel which includes an elongated horizontally disposed helical spring.

A further object of the invention is to provide a spring-driven reel which overcomes the shortcomings of the spring-driven reels which are driven by a "clock" spring.

A further object of the invention is to provide a spring-driven reel which has a much greater life than any prior art spring-driven reel.

Yet another object of the invention is to provide a spring-driven reel wherein the spring or springs thereof may be easily replaced.

Yet another object of the invention is to provide a spring-driven reel which may include one or more helical spring assemblies.

These and other objects will be apparent to those skilled in the art.

BRIEF DESCRIPTION OF THE DRAWINGS

Non-limiting and non-exhaustive embodiments of the present invention are described with refer to the following figures, wherein like reference numerals refer to like parts throughout the various views unless otherwise specified.

DESCRIPTION OF THE PREFERRED EMBODIMENT

Figure 1:
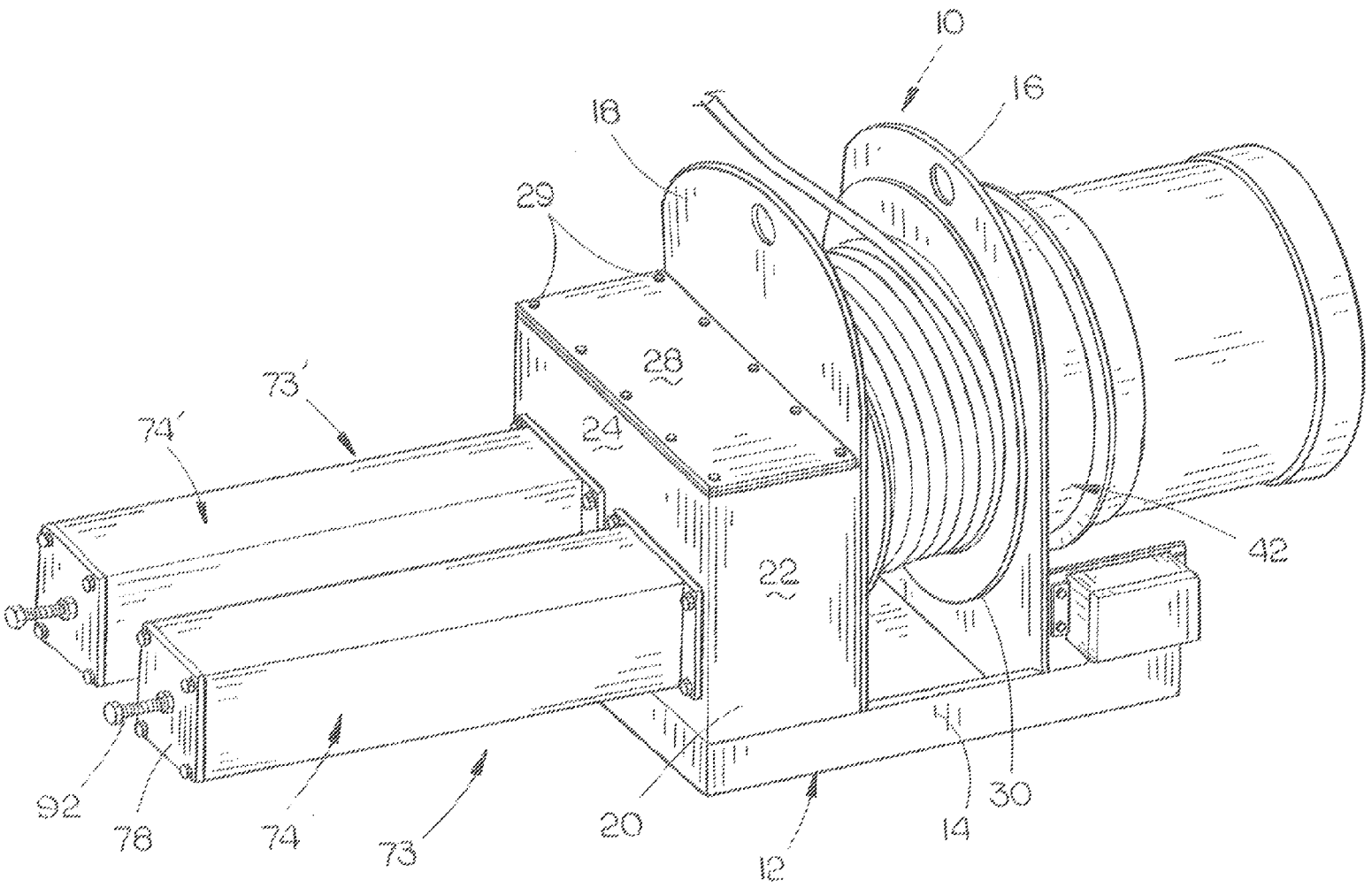
FIG. 1 is a perspective view of the spring-driven reel of this invention with the reel having two helical spring assemblies associated therewith.
Figure 2:
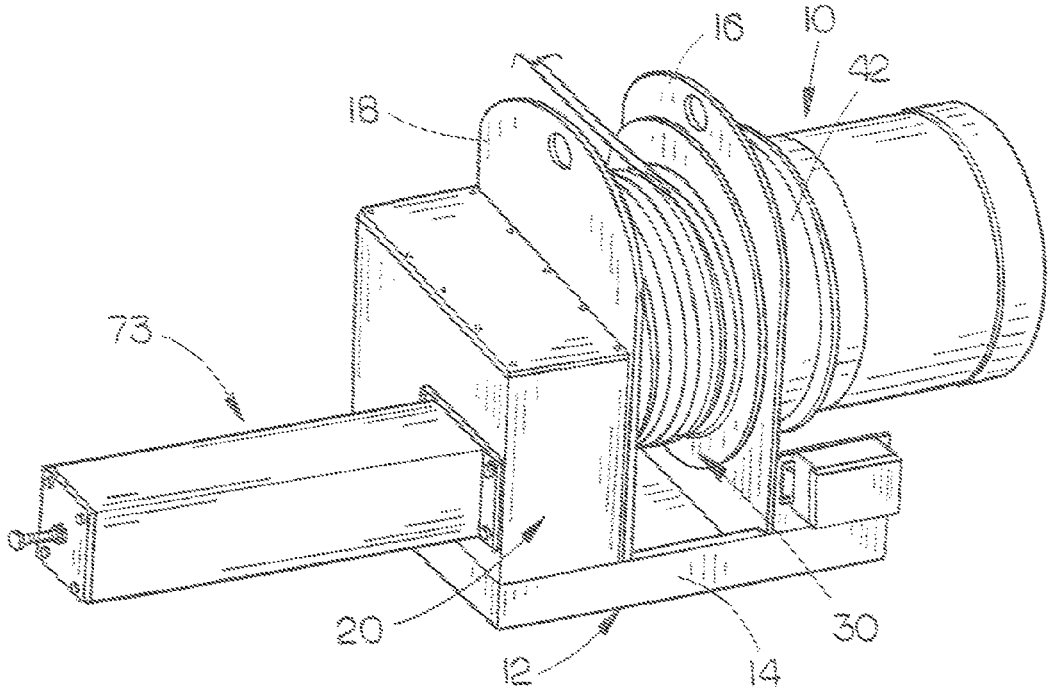
FIG. 2 is a perspective view of the spring-driven reel of this invention with the reel having a single helical spring assembly associated therewith.
Figure 3:
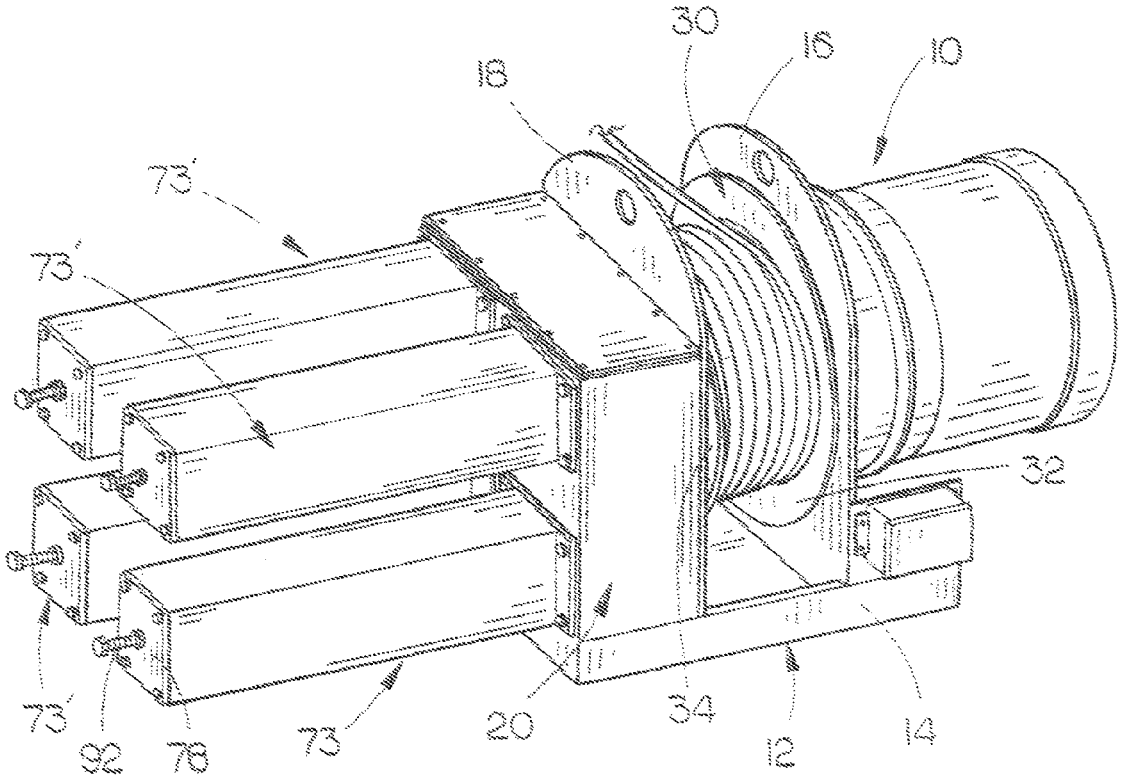
FIG. 3 is a perspective view of the spring-driven reel of this invention with the reel having four helical spring assemblies associated therewith.
Figure 4:
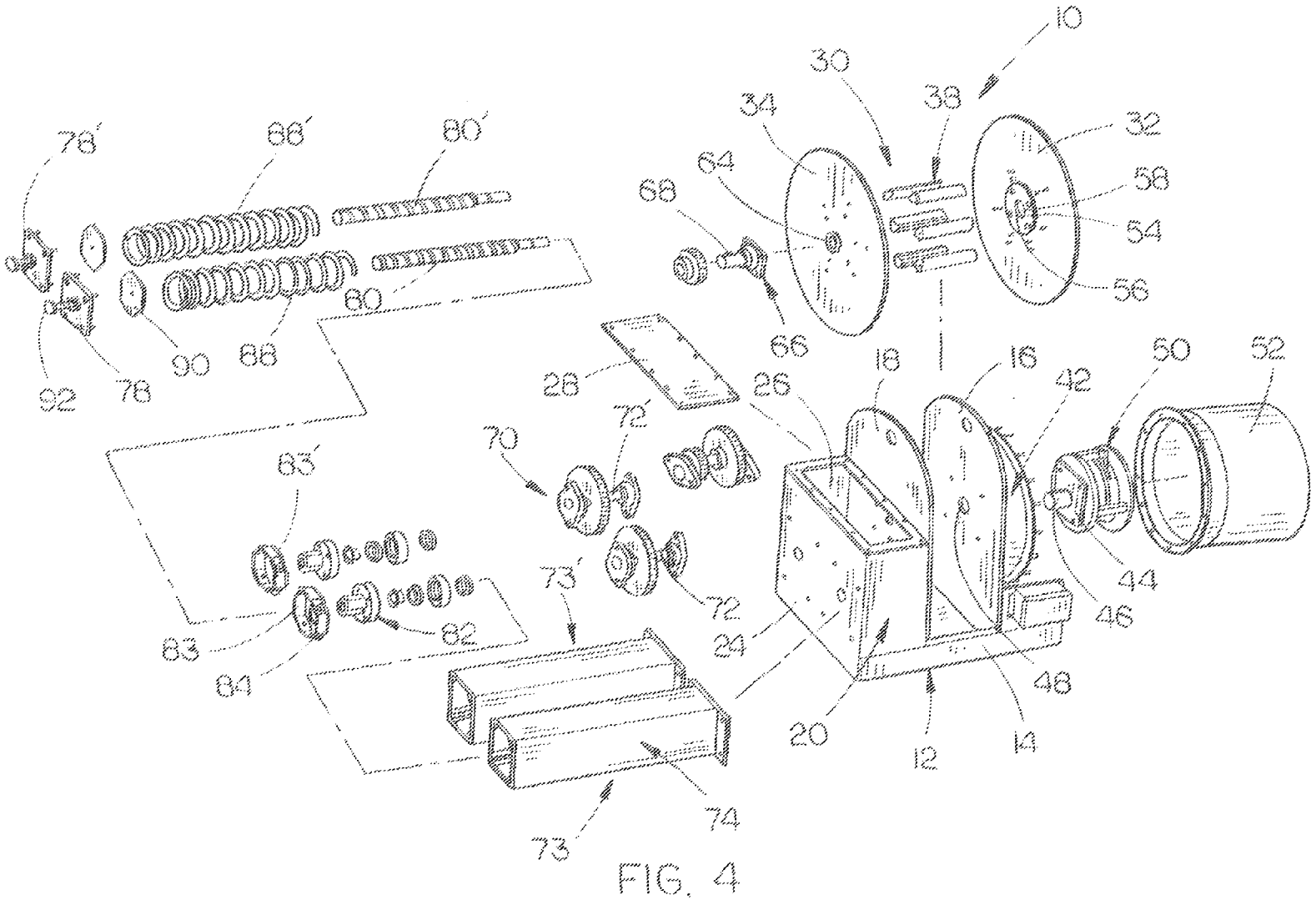
FIG. 4 is an exploded perspective view of the spring-driven reel of FIG. 1.
Figure 5:
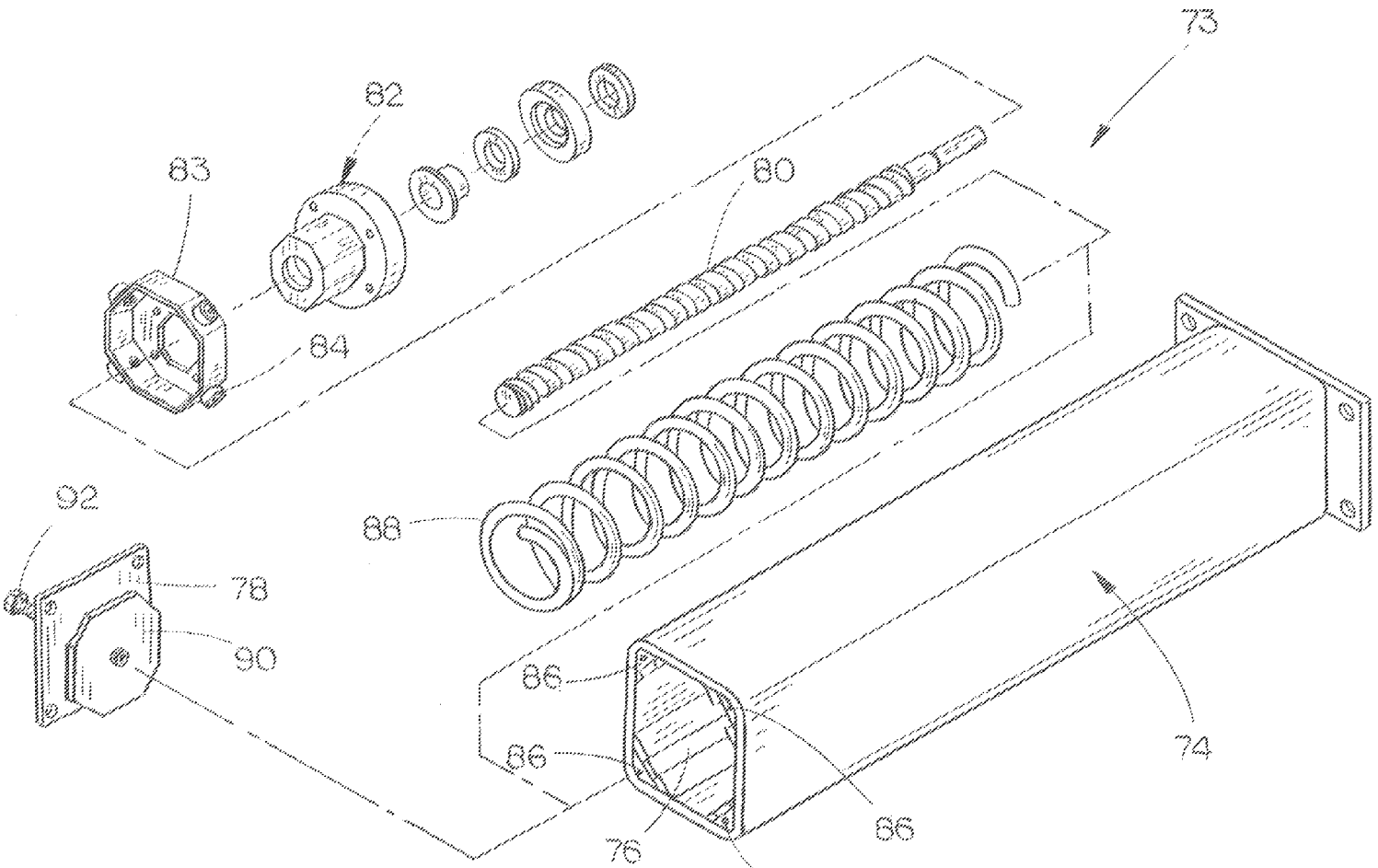
FIG. 5 is an exploded perspective view of the helical spring assembly of this invention.
Figure 6:
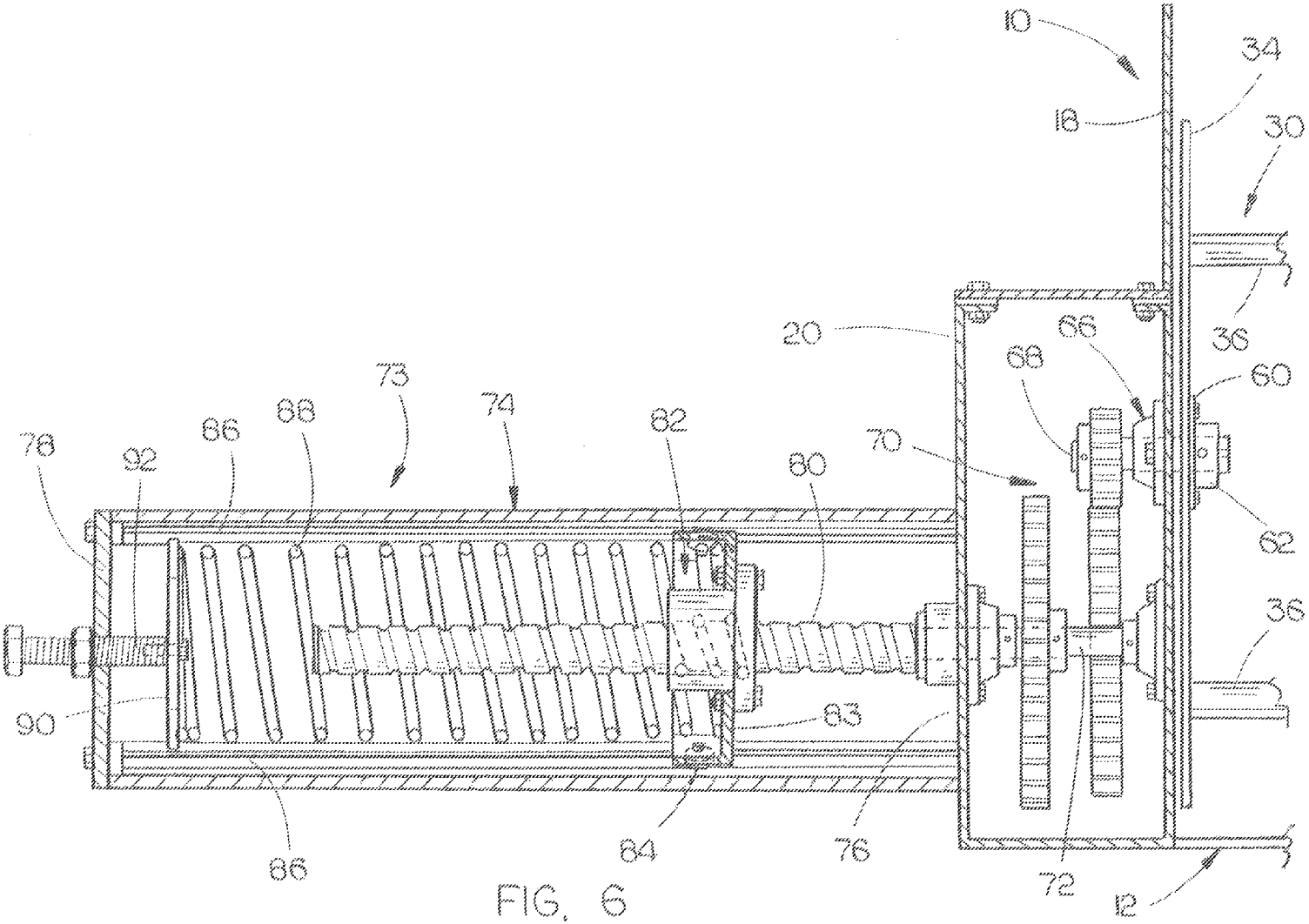
FIG. 6 is a sectional view of the helical spring assembly of FIG. 5.
Figure 7:
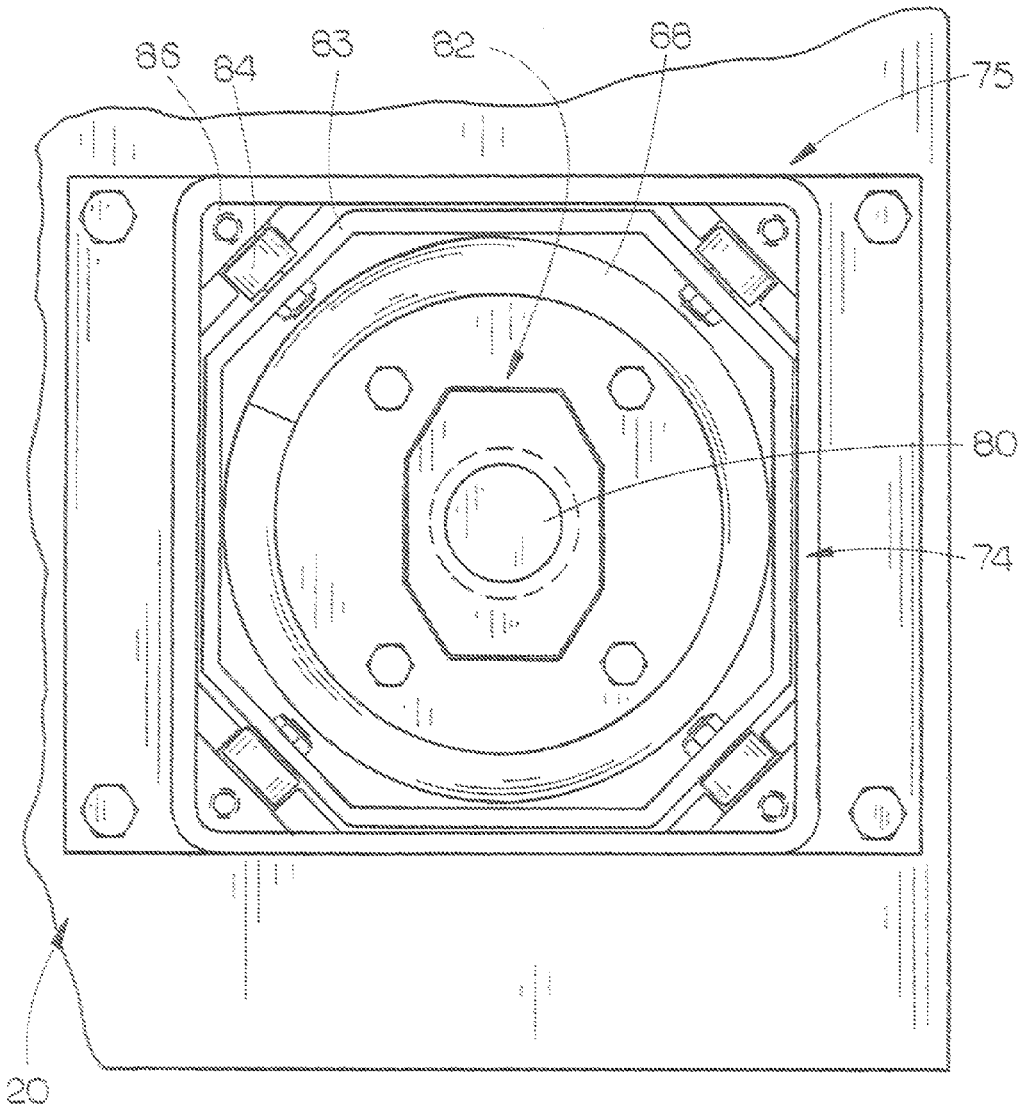
FIG. 7 is an end view of the helical spring assembly of FIG. 5 with the end cap thereof removed.
Figure 8:
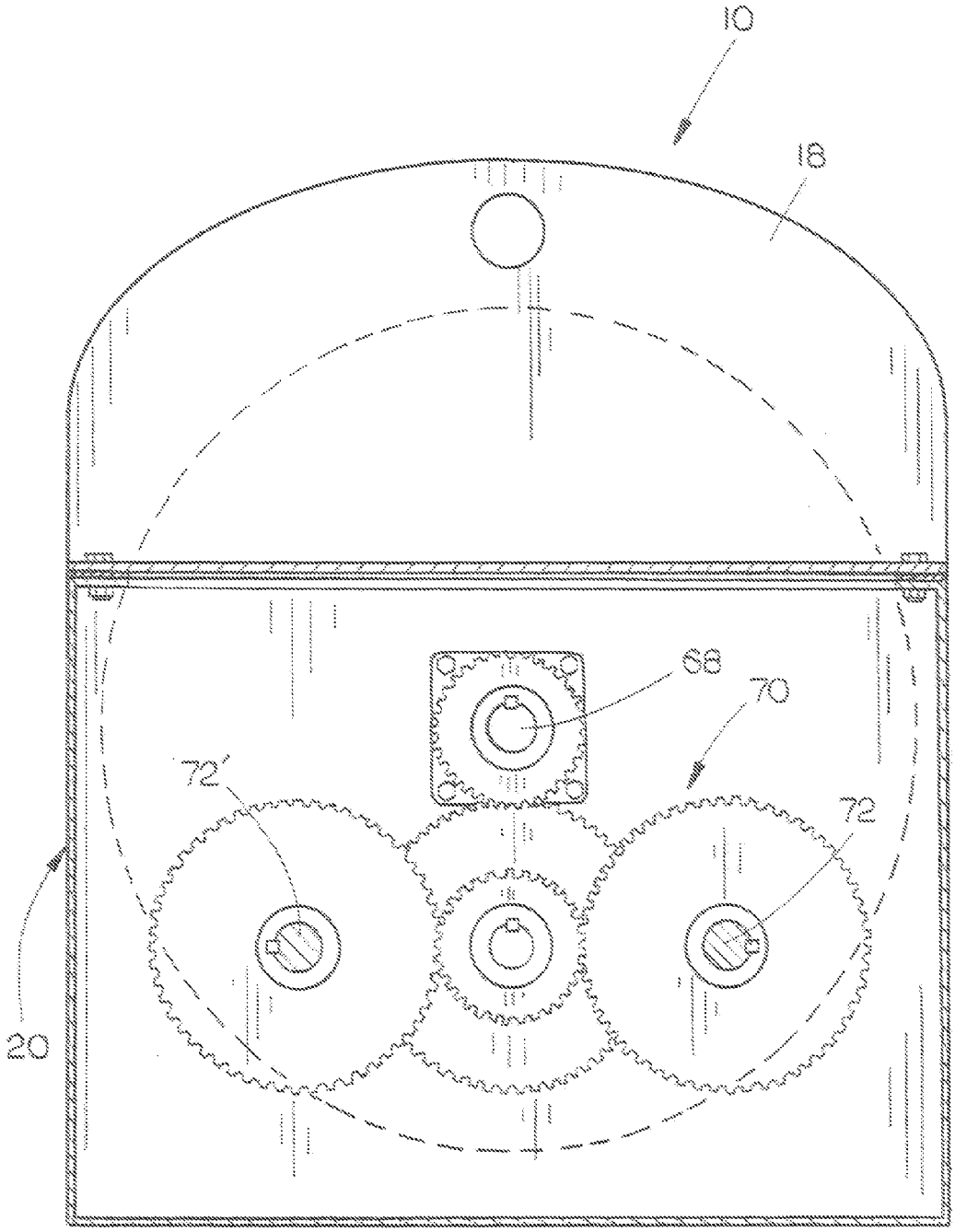
FIG. 8 is a sectional view of the gear assembly of this invention when two helical spring assemblies are utilized.
Figure 9:
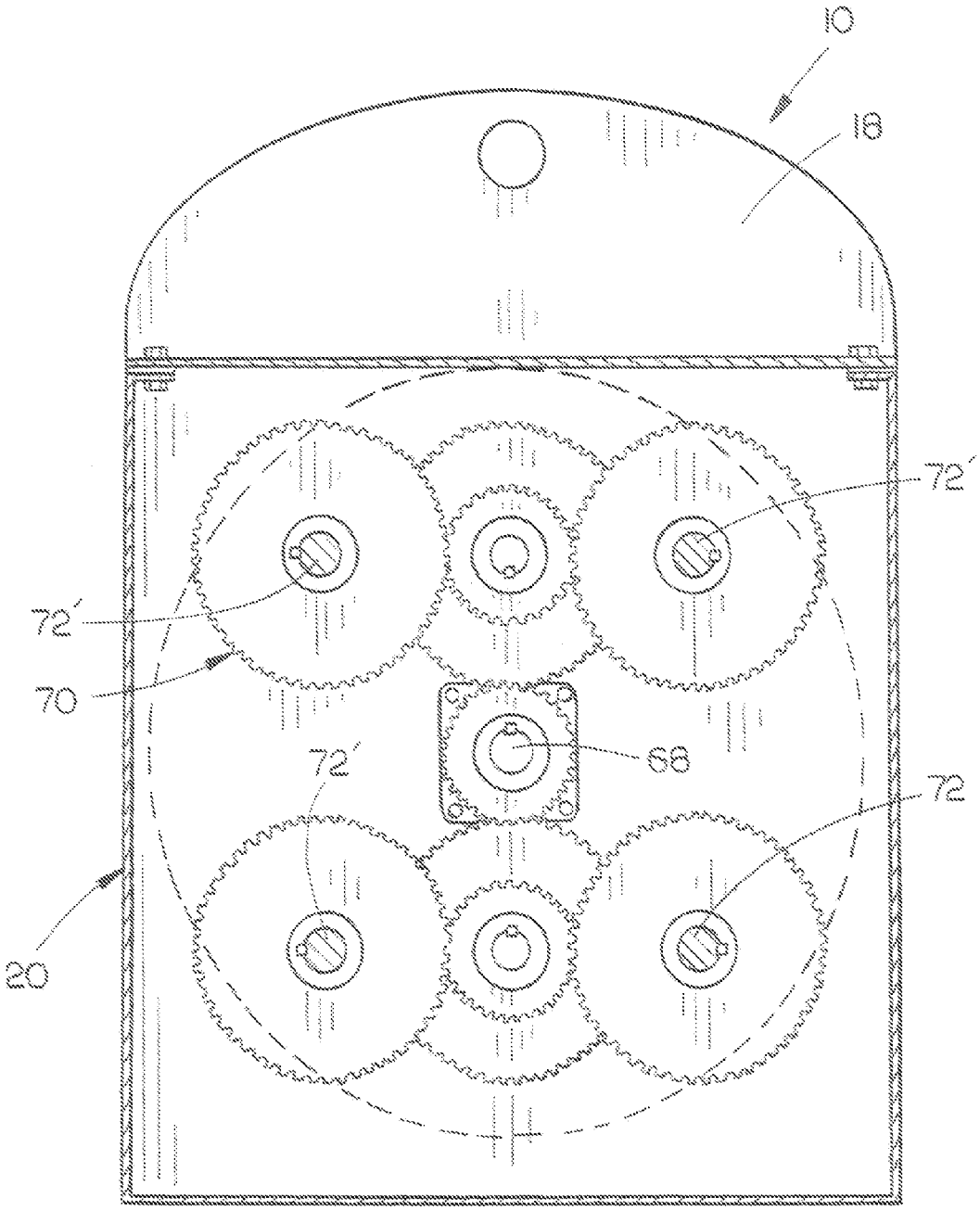
FIG. 9 is a sectional view of the gear assembly of this invention when four helical spring assemblies are utilized.

Embodiments are described more fully below with reference to the accompanying figures, which form a part hereof and show, by way of illustration, specific exemplary embodiments. These embodiments are disclosed in sufficient detail to enable those skilled in the art, to practice the invention. However, embodiments may be implemented in many different forms and should not be construed as being limited to the embodiments set forth herein. The following detailed description is therefore, not to be taken in a limiting sense in that the scope of the present invention is defined only by the appended claims.

The spring-driven reel of this invention is referred to by the reference numeral 10. The reel 10 includes one or more helical spring assemblies as will be described in detail hereinafter. Reel 10 includes a support 12 which is mounted on any convenient supporting structure in a conventional manner such as by bolts, etc. Support 12 includes a horizontally disposed base portion 14. Support members 16 and 18 have their lower ends welded to base portion so that support members 16 and 18 are vertically disposed and are horizontally spaced-apart.

A housing 20 is secured to base portion 14 and support member 18 by welding. The housing 20 includes a first end wall 22, side wall 24, and a second end wall 26. The open upper end of housing 20 is selectively closed by a cover or lid 28 by bolts or screws 29.

The numeral 30 refers to a spool which is positioned between support members 16 and 18 and which is rotatable with respect thereto about a horizontal axis as will be described in greater detail hereinafter. Spool 30 includes spaced-apart flanges 32 and 34. A plurality of spokes 36 have their ends bolted to flanges 32 and 34 so as to extend therebetween to define a drum or drum-like portion 38. A cylindrical slip ring support 42 of convention design is secured to the outer side of support member 16 by bolts or the like. A flange bearing 44 is secured to the outer side of support member 16 by bolts. A slip ring shaft 46 is rotatably mounted in flange bearing 44 which extends through an opening 48 formed in support member 16, Shaft 46 has a conventional slip ring assembly 50 mounted on the outer end thereof. A cover 52 is secured to slip ring support 42 in conventional fashion.

The numeral 54 refers to a disc-shaped plate which has a hub 56 welded thereto. Plate 54 is bolted to the inner side of flange 32 with the hub 56 registering with an opening 58 formed in flange 32. The inner end of shaft 46 extends through the opening 58 in flange 32 and into the hub 56. The shaft 46 is fixed to the hub 56 by a conventional keyway and set screws so that shaft 56 rotates with flange 32 and the spool 30.

The numeral 60 refers to a disc-shaped plate having a hub 62 welded thereto. Plate 60 is bolted to the flange 34 at the inner side thereof so that the hub 62 registers with an opening 64 formed in flange 34. A flange bearing 66 is bolted to the outer side of flange 34 at the opening 64. A shaft 68 extends through flange bearing 66, through opening 64 and into the hub 62. Shaft 68 is secured to the hub 62 by a convention keyway and set screws so that shaft 68 rotates with flange 34 and spool 30. A gear assembly 70 is provided within housing 20 and includes various gears, shafts, bearings, etc., to serve as a connection between the shaft 68 and the helical spring or springs as will be described in more detail hereinafter.

Assuming that two spool retraction devices are to be used, the reel of this invention will now be described with the understanding that one or more helical spring assemblies may be used in association with the spool depending upon the length of the line or cable, the thickness of the line or cable, and the weight of the line or cable. Although the drawings illustrate a reel with a single helical spring assembly, a reel with two helical spring assemblies and a reel with four helical spring assemblies, only a single spring assembly will be described in detail with "'" indicating identical structure on the second, third and fourth helical spring assemblies and related components. If the spring-driven reel of this invention includes a single helical spring assembly, the gear assembly 70 will have a single drive shaft 72 which will be rotated by the rotation of the shaft 68 and vice versa. If two helical spring assemblies are being used, the gear assembly 70 will have two drive shafts 72 and 72' which will be rotated by the rotation of shaft 68 and vice versa. The numeral 73 refers to the helical spring assembly of this invention. Helical spring assembly 73 includes an elongated, horizontally disposed tubular support 74 having an open inner end 76 which is secured to side wall 24 of housing 20 by bolts, which has an opening formed therein which communicates with the open inner end of support 74. The outer end of support 74 is selectively dosed by a cover or plate 78 bolted to support 74. An elongated screw member 80, preferably a conventional ball screw, is rotatably mounted in tubular support 74. A non-rotatable nut 82, preferably a flanged ball nut, is threadably mounted on screw member 80 within tubular support 74 adjacent the inner end of screw member 80. The nut 82 has a square-like support 83 secured thereto which has a configuration such that it cannot rotate with respect to the support 74. The support 83 on nut 82 has rollers 84 mounted on each of the four corners thereof with each of those rollers 84 being received by an elongated guide 86 provided in each of the corners of the support 74.

The inner end of the screw member 80 is operatively interconnected to the shaft 68, for rotation therewith, by the gear assembly 70.

An elongated helical spring 88 embraces screw member 80 within support 74 with the inner end thereof being in engagement with the outer side of the nut 82. To enable some tension of the spring to be preset, a plate 90 is positioned in support 74 at the outer end of spring 88. A threaded bolt 92 extends through cover 78 with the inner end of the bolt 92 engaging the plate 90. As the bolt 92 is threadably moved inwardly through the cover 78, the plate 90 will engage the outer end of the spring 88 to slightly compress the spring 88 to yieldably prevent the spool 30 from rotating when in its fully retracted position. If additional spring force is required, one or more of the helical spring assemblies 73 may be used as previously stated.

Assuming that only one helical spring assembly is used with the reel 10, the reel functions as follows. Assuming that the line or cable is wound onto the spool 30, the bolt 92 would have been previously used to move the plate 90 into engagement with the outer end of spring 88 to compress spring 88 somewhat so that the pre-set tension in spring 88 will maintain spool 80 in its retracted position.

As the line or cable is pulled from the spool 30, the spool will rotate in a first unwinding direction. The rotation of spool 30 in the first direction causes the shaft 68 to also rotate in the first direction since it is fixed to flange 34 for rotation therewith. Rotation of shaft 68 in the first direction causes screw member 80 to also rotate due to its interconnection therewith by the gear assembly 70. As screw member 80 rotates in the first direction, the threads on the screw member 80 will cause the ball nut 82 to longitudinally move, without rotation, towards the outer end of the tubular support 74 thereby compressing spring 88 to place the spring 88 in tension, When the object to which the outer end of the line or cable moves towards the reel 10, the line or cable becomes slightly slack. As the line or cable becomes slack, the tension in the spring 88 causes ball nut 82 to longitudinally move, without rotation, towards the inner end of the tubular support 74. The longitudinal movement of ball nut 82 towards the inner end of the tubular support 74 causes ball screw 80 to be rotated in a winding second direction opposite to the first direction thereby causing shaft 68 and spool 30 to be rotated to take up the slack in the line or cable and winding the line or cable onto the spool 30.

As stated above, if a single helical spring assembly 73 is not sufficient enough to wind large or heavy lines or cable onto the spool 30, additional helical spring assemblies 73 could be utilized with the gear assembly 70 driving the ball screws in those assemblies. Additional helical spring assemblies may also be needed if the line or cable is extremely long.

The helical springs 88 in the helical spring assemblies 73 are much more durable than the springs of the prior art. The long life of the springs 88 results in much less repair and/or replacement.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A spring-driven reel, comprising:

a first support;

an upstanding first support member having a lower end, an upper end, an outer side and an inner side;

said lower end of said first support member being secured to said first support;

an upstanding second support member having a lower end, an upper end, an outer side and an inner side;

said lower end of said second support member being secured to said first support so as to be horizontally spaced from said first support member;

a spool positioned between said first and second support members;

said spool being rotatably mounted, about a horizontal axis, on said first and second support members;

said spool including first and second vertically disposed and horizontally spaced-apart flanges having a central drum extending therebetween;

said spool adapted to have an elongated line or cable wound on said drum;

a horizontally disposed shaft having first and second ends;

said first end of said shaft being fixed to said second flange for rotation therewith;

said shaft extending horizontally outwardly from said second flange of said spool;

said spool and said shaft being rotatable in a first direction and a second direction;

the rotation of said spool and said shaft in said first direction permitting the line or cable to be unwound from said spool;

the rotation of said spool and said shaft in said second direction causing the line or cable to be wound upon said drum of said spool;

a housing secured to said first support laterally outwardly of said second support member;

a horizontally disposed second support having a first end and a closed second end;

said second support extending horizontally laterally outwardly from said housing;

an elongated, horizontally disposed screw member having first and second ends;

said first screw member being rotatably mounted in said second support;

a non-rotatable nut longitudinally movably mounted on said screw member in said second support at said first end of said screw member;

an elongated helical spring having first and second ends;

said screw member extending through said helical spring;

said helical spring being mounted on said screw member so that said first end of said helical spring operatively engages said non-rotatable nut and so that said second end of said helical spring operatively engages said closed second end of said second support;

said first end of said screw member being operatively connected to said second end of said shaft whereby rotation of said shaft causes said screw member to be rotated;

the rotation of said shaft in said first direction by the line or cable being unwound from said drum of said spool causing said screw member to be rotated with respect to said non-rotatable nut which causes said nut to be longitudinally moved on said screw member towards said second end of second support thereby compressing said helical spring to put said helical spring in tension;

the tension in said helical spring, after said helical spring has been compressed by the rotation of said first shaft in said first direction causing said non-rotatable nut to be longitudinally moved on said screw member thereby causing said screw member, said first shaft, and said spool to be rotated in said second direction upon the occurrence of slack in the line or cable.

2. The spring-driven reel of claim 1 wherein a cap selectively closes said second end of said second support.

3. The spring-driven reel of claim 2 wherein a threaded member extends into said cap for operative engagement with said second end of said helical spring to selectively initially partially compress said helical spring.

4. The spring-driven reel of claim 1 further including structure which prevents the rotation of said nut on said screw member upon the rotation of said screw member.

5. The spring-driven reel of claim 1 wherein said screw member is a ball screw and wherein said nut is a ball nut.

6. The spring-driven reel of claim 5 wherein said ball nut is a flanged ball nut.

7. The spring-driven reel of claim 1 wherein a gear assembly is positioned in said first housing which interconnects said second end of said shaft to said first end of said screw member.

8. A spring-driven reel, comprising:

a first support;

an upstanding first support member having a lower end, an upper end, an outer side and an inner side;

said lower end of said first support member being secured to said first support;

an upstanding second support member having a lower end, an upper end, an outer side and an inner side;

said lower end of said second support member being secured to said first support so as to be horizontally spaced from said first support member;

a spool positioned between said first and second support members;

said spool being rotatably mounted on said first and second support members;

said spool adapted to have an elongated line or cable wound thereon;

said spool including first and second vertically disposed and horizontally spaced-apart disc-shaped flanges having a central drum-like portion extending therebetween;

a first horizontally disposed shaft having first and second ends;

said first end of said shaft being fixed to said second flange for rotation therewith;

said first shaft extending horizontally outwardly from said second flange;

said spool and said first shaft being rotatable in a first direction and a second direction;

the rotation of said spool and said first shaft in said first direction permitting the line or cable to be unwound from said spool;

the rotation of said spool and said first shaft in said second direction causing the line or cable to be wound upon said drum-like portion of said spool;

a first housing secured to said first support outwardly of said second support member;

a horizontally disposed second support having a first end and a closed second end;

said second support extending laterally from said first housing;

an elongated, horizontally disposed first screw member having first and second ends;

said first screw member being rotatably mounted in said second support;

a first non-rotatable nut longitudinally movably mounted on said first screw member in said second support adjacent said first end of said first screw member;

an elongated first helical spring having first and second ends;

said first screw member extending through said first helical spring;

said first helical spring being mounted on said first screw member so that said first end of said first helical spring engages said first non-rotatable nut and so that said second end of said first helical spring operatively engages said closed second end of said second support;

said first end of said first screw member being operatively connected to said second end of said first shaft whereby rotation of said first shaft causes said first screw member to be rotated;

a horizontally disposed third support having a first end and a closed second end;

said third support extending laterally from said first housing and being spaced from said second support;

an elongated, horizontally disposed second screw member having first and second ends;

said second screw member being rotatably mounted in said third support;

a second non-rotatable nut movably mounted on said second screw member in said third support adjacent said first end of said second screw member;

an elongated second helical spring having first and second ends;

said second screw member extending through said second helical spring;

said second helical spring being mounted on said second screw member so that said first end of said second helical spring operatively engages said second non-rotatable nut and so that said second end of said second helical spring operatively engages said closed second end of said third support;

said first end of said second screw member being operatively connected to said second end of said first shaft whereby rotation of said first shaft causes said second screw member to be rotated;

the rotation of said first shaft in said first direction by the line being unwound from said spool causing said first and second screw members to be rotated with respect to said first and second non-rotatable nuts respectively which causes said first and second non-rotatable nuts to be longitudinally moved on said first and second screw members respectively towards said second ends of said second and third supports respectively thereby compressing said first and second helical springs to put said first and second helical springs in tension;

the tension in said first and second helical springs, after said first and second helical springs have been compressed by the rotation of said first shaft in said first direction causing said first and second non-rotatable nuts to be longitudinally moved on said first and second screw members respectively thereby causing said first and second screw members, said first shaft and said spool to be rotated in said second direction upon the occurrence of slack in the line or cable.

9. The spring-driven reel of claim 8 wherein a cap selectively closes each of said second ends of said second and third supports.

10. The spring-driven reel of claim 9 wherein a threaded member extends into each of said caps of said second and third supports for operative engagement with said second ends of said first and second helical springs respectively to selectively partially compress said first and second helical springs.

11. The spring-driven reel of claim 8 further including structure which prevents the rotation of said first and second non-rotatable nuts on said first and second screw members respectively, upon the rotation of said first and second screw members.

12. The spring-driven reel of claim 8 wherein said first and second screw members are ball screws and wherein said first and second non-rotatable nuts are ball nuts.

13. The spring-driven reel of claim 12 wherein said ball nuts are flanged ball nuts.

14. The spring-driven reel of claim 8 wherein a gear assembly is positioned in said first housing which interconnects said second end of said first shaft to said first ends of said first and second screw members.

15. A spring-driven reel, comprising:

an upstanding support;

a spool rotatably mounted on said support about a horizontally disposed axis;

said spool adapted to have an elongated line or cable wound thereon;

a horizontally disposed shaft secured to said spool for rotation therewith;

said shaft extending horizontally outwardly from said spool and said support;

said spool and said shaft being rotatable in a first direction and a second direction;

the rotation of said spool and said shaft in said first direction permitting the line or cable to be unwound from said spool;

the rotation of said spool and said shaft in said second direction causing the line or cable to be wound upon said drum-like portion of said spool;

a housing secured to said support;

a horizontally disposed second support having a first end and a closed second end;

said second support extending horizontally laterally outwardly from said housing;

an elongated, horizontally disposed screw member having first and second ends;

said first screw member being rotatably mounted in said second support;

a non-rotatable nut movably mounted on said screw member in said second support adjacent said first end of said screw member;

an elongated helical spring having first and second ends;

said screw member extending through said helical spring;

said helical spring being mounted on said screw member so that said first end of said helical spring operatively engages said non-rotatable nut and so that said second end of said helical spring operatively engages said closed second end of said second support;

said first end of said screw member being operatively connected to said second end of said shaft whereby rotation of said shaft causes said screw member to be rotated;

the rotation of said shaft in said first direction by the line or cable being unwound from said drum-like portion of said spool causing said screw member to be rotated with respect to said non-rotatable nut which causes said nut to be longitudinally moved on said screw member towards said second end of second support thereby compressing said helical spring to put said helical spring in tension;

the tension in said helical spring, after said helical spring has been compressed by the rotation of said first shaft in said first direction causing said non-rotatable nut to be longitudinally moved on said screw member thereby causing said screw member, said first shaft, and said spool to be rotated in said second direction upon the occurrence of slack in the line or cable.

16. The spring-driven reel of claim 15 wherein a cover selectively closes said second end of said second support.

17. The spring-driven reel of claim 16 wherein a threaded member extends into said cover for operative engagement with said second end of said helical spring to selectively initially partially compress said helical spring.

18. The spring-driven reel of claim 15 further including structure which prevents the rotation of said nut on said screw member upon the rotation of said screw member.

19. The spring-driven reel of claim 15 wherein said screw member is a ball screw and wherein said nut is a ball nut.

20. The spring-driven reel of claim 15 wherein a gear assembly is positioned in said first housing which interconnects said second end of said shaft to said first end of said screw member.

* * * * *